US006708643B2

(12) United States Patent
Traiforos

(10) Patent No.: US 6,708,643 B2
(45) Date of Patent: Mar. 23, 2004

(54) PORTABLE AIRPORT TRAFFIC BARRICADE

(75) Inventor: Mark Traiforos, Streamwood, IL (US)

(73) Assignee: TMC Safety Products, Inc., Chicago, IL (US)

( * ) Notice: Subject to any disclaimer, the term of this patent is extended or adjusted under 35 U.S.C. 154(b) by 194 days.

(21) Appl. No.: 09/843,035

(22) Filed: Apr. 25, 2001

(65) Prior Publication Data

US 2002/0157595 A1 Oct. 31, 2002

(51) Int. Cl.[7] ..... E01F 13/00
(52) U.S. Cl. ..... 116/63 R; 116/63 P
(58) Field of Search ..... 116/63 P, 63 R, 116/DIG. 16; 40/612, 606, 602; 404/6, 9

(56) References Cited

U.S. PATENT DOCUMENTS

| | | | | | |
|---|---|---|---|---|---|
| 3,015,804 | A | * | 1/1962 | Nunn | 116/63 P |
| 3,616,557 | A | * | 11/1971 | Vara | 40/602 |
| 3,868,630 | A | * | 2/1975 | Lesondak | 116/63 P |
| 4,005,537 | A | * | 2/1977 | von Camber et al. | 40/612 |
| 4,059,915 | A | | 11/1977 | Owens | |
| 4,108,311 | A | | 8/1978 | McClendon | |
| 4,124,196 | A | * | 11/1978 | Hipskind | 116/63 P |
| 4,232,466 | A | * | 11/1980 | Mathis | 40/606 |
| 4,248,001 | A | * | 2/1981 | Feuvray | 40/606 |
| 4,372,536 | A | | 2/1983 | Morse | |
| 4,411,085 | A | * | 10/1983 | Farmer | 40/612 |
| 4,674,432 | A | | 6/1987 | Schmanski | |
| 4,778,250 | A | * | 10/1988 | McRosley et al. | 40/606 |
| D327,658 | S | | 7/1992 | Kulp et al. | |
| 5,342,140 | A | | 8/1994 | Glass | |
| 5,382,112 | A | * | 1/1995 | Fu | 116/63 P |
| 5,544,614 | A | | 8/1996 | Cushman | |
| 5,667,175 | A | * | 9/1997 | Brady | 40/606 |
| 5,729,215 | A | | 3/1998 | Jutras | |
| 5,762,444 | A | | 6/1998 | Giannelli | |
| 6,009,652 | A | | 1/2000 | Smith | |
| 6,178,673 | B1 | | 1/2001 | Blackford et al. | |

FOREIGN PATENT DOCUMENTS

| | | | | | |
|---|---|---|---|---|---|
| FR | 002606199 | A1 | * | 7/1988 | 40/612 |
| GB | 2194268 | A | * | 3/1988 | 116/63 P |

* cited by examiner

*Primary Examiner*—Diego Gutierrez
*Assistant Examiner*—Travis Reis
(74) *Attorney, Agent, or Firm*—Niro, Scavone, Haller & Niro

(57) ABSTRACT

A portable barricade for use in separating aircraft and ground vehicles comprises a sign panel hanging from a horizontally extending frame member, the frame member and sign panel being supported by first and second pairs of expandable legs. The first and second pairs of legs are supported by two cross braces, the first having a tubular configuration and the second having a planar configuration. The barricade is positioned having its tubular cross brace adjacent the aircraft traffic and the planar cross brace adjacent the ground vehicle traffic. Air flow or exhaust generated by aircraft exert a greater force on the planar cross brace than on the tubular cross brace, tending to maintain the barricade with its legs in an expanded, operational position.

6 Claims, 1 Drawing Sheet

PORTABLE AIRPORT TRAFFIC BARRICADE

BACKGROUND OF THE INVENTION

The present invention relates generally to barricades and, more particularly, to portable barricades used at airport facilities to separate aircraft from ground vehicles.

Because of construction and repair work conducted at operational airports, and for other reasons, it is often necessary to route aircraft and ground vehicle traffic in relatively close proximity. In such circumstances, portable barricades are often used to maintain safe separation between the aircraft and the ground vehicles. It is desirable that the barricades be relatively light to facilitate their transport and set up, while ensuring that the barricades remain operationally stable even when exposed to propeller wash or exhaust generated by the aircraft moving in close proximity. In the past, separate sand bags have been placed on the barricades, but the sand bags themselves are heavy and require additional time and labor when setting up the barricades. Additionally, sand bags often leak, discharging sand onto runways or adjacent airport traffic areas.

A need exists, therefore, for a truly portable barricade which can remain upright and operational when subject to high air flows from propeller-driven aircraft or from high velocity exhaust from jet aircraft.

SUMMARY OF THE INVENTION

The present invention is directed to a portable barricade for use in separating aircraft traffic and ground vehicles comprising an appropriately marked sign panel hanging from a horizontally extending frame member, the frame member and sign panel being supported by first and second pairs of legs that expand to form what is generally known as an A-frame barricade. The first and second pairs of legs are supported by two cross braces, the first having a tubular configuration and the second having a planar configuration. The barricade is positioned so that the side of the barricade having the tubular cross brace is adjacent the aircraft traffic, with the side having the planar cross brace adjacent the ground vehicle traffic. In this way, the airflow or exhaust generated by aircraft will exert a greater force on the planar cross brace than on the tubular cross brace, tending to maintain the barricade with its legs in an expanded, operational position.

BRIEF DESCRIPTION OF THE DRAWINGS

These and other features, objects and advantages of the present invention will become apparent from the following description and drawings wherein like reference numerals represent like elements in several views, and in which.

DETAILED DESCRIPTION OF THE PREFERRED EMBODIMENTS

Figure 1:
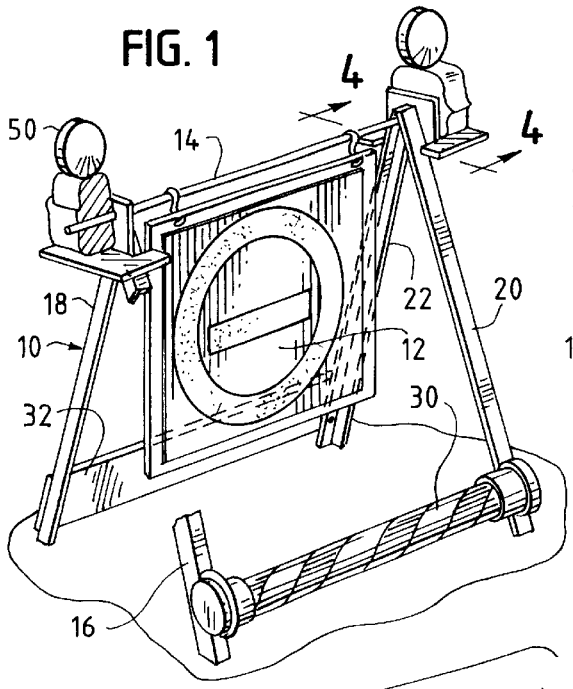
FIG. 1 is a perspective view illustrating one preferred embodiment of the present invention.
Figure 2:
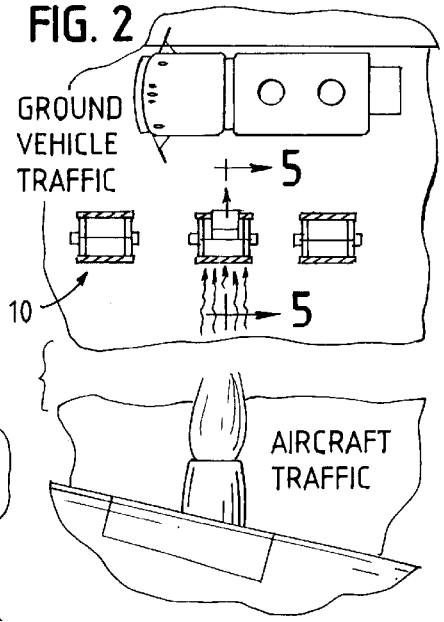
FIG. 2 is a plan view illustrating the placement of the portable barricade at an airport facility between aircraft and ground vehicle traffic.
Figure 5:
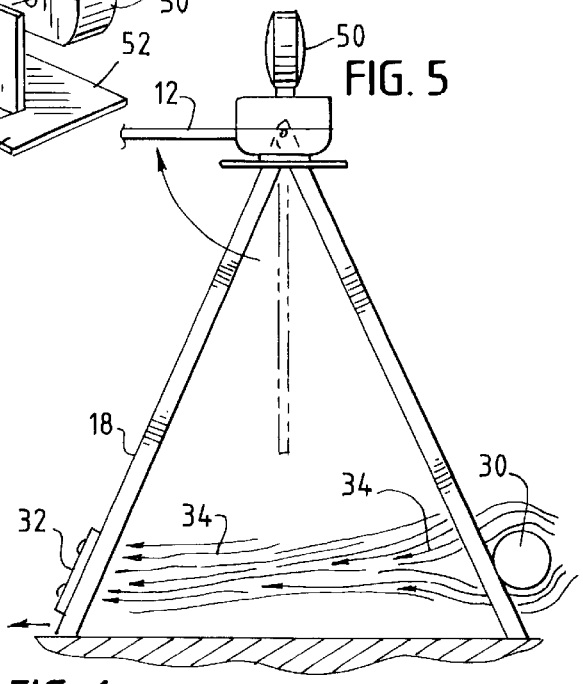
FIG. 5 is a view of the barricade shown in FIG. 1 and taken along line 5—5 of FIG. 2, illustrating the barricade's function when subject to aircraft generated airflow or exhaust.
Figure 4:
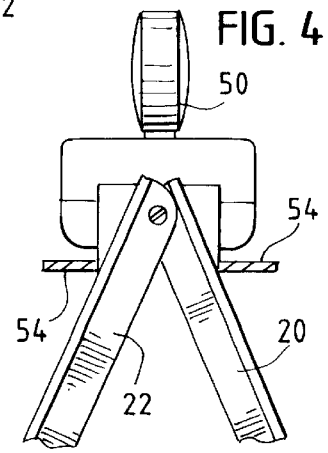
FIG. 4 is a cross-sectional view taken along line 4—4 in FIG. 1.
Figure 6:
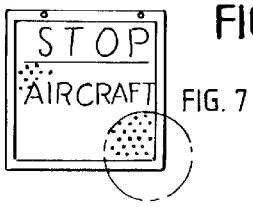
FIG. 6 is a front view of a suitable sign panel for use in the portable barricade shown in FIG. 1.
Figure 7:
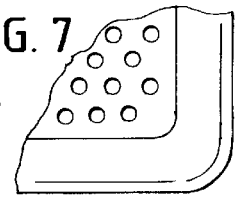
FIG. 7 is an enlarged segment view taken from FIG. 6 showing the arrangement of perforations in the sign panel.

A portable and collapsible barricade 10 is illustrated in FIGS. 1 and 2, being positioned to separate aircraft traffic from ground vehicle traffic. The barricade 10 includes a sign panel 12, with suitable markings on both sides, hanging from a horizontal frame member 14. The frame member and sign panel are supported by four legs; legs 16 and 18, forming one pair, and being pivotally secured at one end of the frame member 14, while legs 20 and 22 form the second pair and are pivotally secured at the other end of the frame member. Each pair of legs is moveable between a collapsed storage position and an expanded operational position. The expanded operational position is illustrated in FIGS. 1 and 5. Cross braces 30 and 32 are employed to provide structural support to the barricade 10 and to promote other advantages of the invention. One cross brace 30 has a generally tubular configuration and may be secured to legs 16 and 20 via U-bolts or any other well known securement technique. The other cross brace 32 has a generally planar configuration and is secured to legs 18 and 22 by bolts, or again by any conventional fastening mechanism. In accordance with the present invention, the tubular cross brace 30 generates less resistance to air flows or exhaust gases generated by nearby aircraft than does planar cross brace 32. As a result, when the barricade is properly positioned between aircraft and other ground traffic, the aircraft air or jet blasts directed at the barricade (see generally Arrows 34 in FIG. 5) will generate greater forces on the planar cross brace 32 than on the tubular cross brace 30, thereby maintaining the barricade's legs in their expanded, upright orientation.

Another feature of the invention is that, although the barricade 10 is capable of maintaining an upright operational position in the face of propeller wash or jet blast, it will readily collapse upon mechanical impact from aircraft or ground vehicles, minimizing damage to the barricade, aircraft or vehicle.

Figure 3:
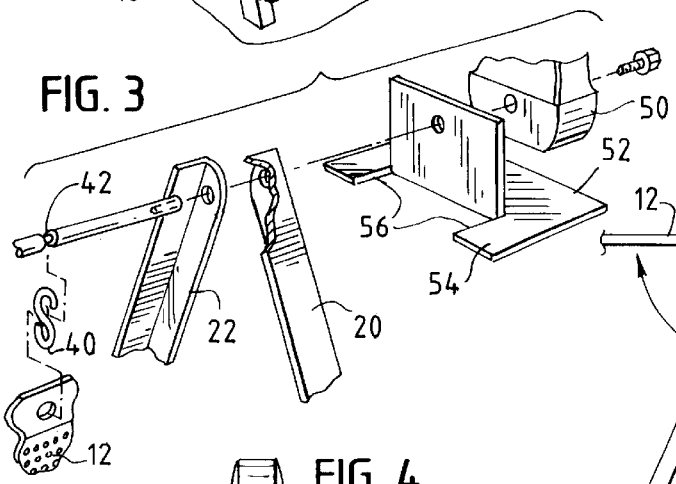
FIG. 3 is a partial exploded perspective view of a portion of the barricade illustrated in FIG. 1, showing details of the light mounting bracket.

Preferably, the barricade employs a sign panel 12 approximately 2 ft. by 2 ft. in size and constructed from aluminum or other metal or rigid material. To minimize wind induced movement of the sign panel, it is preferably perforated. Quarter-inch diameter holes on three-eighths inch staggered centers have been found desirable in minimizing wind sway while maintaining optical clarity of the traffic markings. As shown in FIGS. 3 and 5, the sign panel 12 is also mounted to rotate vertically through 360° around frame member 14 and is maintained at a central position in barricade 10 by nesting the hanging brackets 40 within annular recesses 42 on frame 14.

For a sign panel as described above, the tubular cross brace 30 is preferably constructed from four to five inch diameter PVC tubing, although other plastics or metals may also perform satisfactorily. A cylindrical configuration is preferred, but other tubing geometries, such as rectangular or triangular, may be employed, so long as the tubing dimension is minimized. In turn, the planar cross brace will preferably have minimum width of about five inches. It is also desirable to fill tubular cross brace 30 with a ballast material, such as sand.

Alternatively, the cross braces 30 and 32 may have other geometries provided the drag forces generated by the aircraft propeller wash or exhaust on the cross braces results in a net force tending to expand the barricade legs. It should be noted that the angular disposition of the cross brace 32 creates a lift force component acting on the barricade.

The ballast, for a barricade of the general size described above, will typically add about 25 pounds to the weight of the barricade, which in turn will have a total weight of about 40 pounds. Thus, the barricade is relatively lightweight, but will nonetheless withstand propeller wash and jet blasts from proximate aircraft.

As illustrated in FIGS. 1 and 3, the barricade 10 includes a pair of safety lights 50 which are mounted at opposed ends of the horizontal frame member 14 via mounting brackets 52. The brackets 52 allow the lights to swivel when the barricade is collapsed, minimizing damage during transport or storage. The brackets 52 include tabs 54 each defining an internal shoulder or abutment 56 which act to limit the expansion of legs 16 and 18 and legs 20 and 22. In addition, the shoulders 56 on each bracket 52 also act to self-align the lights in a generally horizontal orientation for proper optical positioning.

While the invention has been described with reference to the preferred embodiments thereof, it will be appreciated that numerous variations, modifications, and alternate embodiments are possible including the use of the apparatus with objects other than fasteners. Accordingly, all such variations, modifications, and alternate embodiments are to be regarded as being within the spirit and scope of the invention.

I claim:

1. A portable barricade for use in separating aircraft traffic from ground vehicle traffic comprising:

a horizontal frame member having opposed ends;

a sign panel depending from said horizontal member;

a first pair of legs, having upper and lower ends, pivotally secured at their upper ends to one opposed end of the horizontal member;

a second pair of legs, having upper and lower ends, pivotally secured at their upper ends to the other opposed end of the horizontal member;

said pairs of legs being moveable between a collapsed storage position and an expanded operational position;

a first cross brace secured between said first and second pairs of legs, and a second cross brace secured between said first and second pairs of legs, each of said cross braces being positioned below the sign panel, said first and second cross braces having different asymmetrical configurations so that the resistance to gas flow passing said cross braces is less for said first cross brace and greater for said second cross brace; and said barricade being positionable so that the first cross brace is located on a side facing the airplane traffic and the second cross brace is located on a side facing the ground vehicle traffic, whereby air flow or exhaust generated by the aircraft will exert a force on the second cross brace greater than the force on said first cross brace to thereby maintain the legs of said barricade in the expanded operational position.

2. The portable barricade of claim 1 wherein said sign panel is perforated.

3. The portable barricade of claim 1 wherein the sign panel may rotate vertically through 360° around the horizontal frame member.

4. The portable barricade of claim 1 wherein the first cross brace is a closed tube and filled with a ballast material.

5. The portable barricade of claim 1 further comprising a pair of light assemblies, each being pivotally mounted at an opposed end of the horizontal frame assembly and including a mounting bracket which cooperates with one of the pairs of legs to self-align the assembly in a generally horizontal orientation.

6. The portable barricade of claim 1 wherein the first cross brace has a generally tubular construction and the second cross brace has a generally planar construction.

* * * * *